US006358061B1

(12) United States Patent
Regnier

(10) Patent No.: US 6,358,061 B1
(45) Date of Patent: Mar. 19, 2002

(54) HIGH-SPEED CONNECTOR WITH SHORTING CAPABILITY

(75) Inventor: Kent E. Regnier, Lombard, IL (US)

(73) Assignee: Molex Incorporated, Lisle, IL (US)

( * ) Notice: Subject to any disclaimer, the term of this patent is extended or adjusted under 35 U.S.C. 154(b) by 0 days.

(21) Appl. No.: 09/436,862

(22) Filed: Nov. 9, 1999

(51) Int. Cl.[7] ..... H01R 12/00
(52) U.S. Cl. ..... 439/60; 439/515; 439/637
(58) Field of Search ..... 439/60, 188, 635, 439/636, 637, 515

(56) References Cited

U.S. PATENT DOCUMENTS

| | | | | |
|---|---|---|---|---|
| 3,422,394 A | | 1/1969 | Antes | 339/176 |
| 3,474,387 A | * | 10/1969 | Krum et al. | 439/635 |
| 3,944,313 A | | 3/1976 | McKeown et al. | 339/75 |
| 4,087,151 A | | 5/1978 | Robert et al. | 339/176 |
| 4,106,841 A | | 8/1978 | Vladic | 339/176 |
| 4,354,729 A | | 10/1982 | Grabbe et al. | 339/258 |
| 4,370,012 A | | 1/1983 | Grabbe et al. | 339/75 |
| 4,418,475 A | | 12/1983 | Ammon et al. | 29/842 |
| 4,701,002 A | | 10/1987 | Mouissie | 439/426 |
| 4,927,369 A | | 5/1990 | Grabbe et al. | 439/66 |
| 5,035,632 A | | 7/1991 | Rudoy et al. | 439/108 |
| 5,092,783 A | | 3/1992 | Suarez et al. | 439/71 |
| 5,098,306 A | | 3/1992 | Noschese et al. | 439/188 |
| 5,277,607 A | | 1/1994 | Thumma et al. | 439/188 |
| 5,575,687 A | | 11/1996 | Tsai | 439/637 |
| 5,676,555 A | | 10/1997 | Yu et al. | 439/157 |
| 5,853,303 A | * | 12/1998 | Brunker et al. | 439/60 |
| 5,913,700 A | | 6/1999 | Tobey et al. | 439/637 |
| 6,149,467 A | * | 11/2000 | Choy | 439/515 |

* cited by examiner

*Primary Examiner*—P. Austin Bradley
*Assistant Examiner*—Briggitte R. Hammond
(74) *Attorney, Agent, or Firm*—Charles S. Cohen; Thomas D. Paulius

(57) ABSTRACT

A connector for high speed applications includes both signal and reference or power terminals arranged on opposite sides of a circuit-card receiving slot of the connector. The reference or power terminals have a pair of spring arms that extend up from a body portion and are spaced apart from each other. Insertion of a circuit card into the card slot deflects one of the two spring arm portions secondary into shorting contact with the other spring arm portion. The circuit paths are thus defined in the terminal, which increases the performance of the connector. The shorting contact is obtained by the two spring arm portions engaging each other along opposing sides to reduce the force needed to effect shorting contact.

22 Claims, 4 Drawing Sheets

HIGH-SPEED CONNECTOR WITH SHORTING CAPABILITY

BACKGROUND OF THE INVENTION

The present invention relates generally to electrical connectors, and more particularly to high speed connectors utilized in edge connector applications having multiple circuit paths to increase the electrical performance thereof.

Electronic devices being manufactured today are operating at faster performance speeds than past devices. Such devices, especially computing devices, in order to compute in today's technological environment, need to have the capability of performing data transfer at high rates. While electronic devices, such as laptop and other portable computers are being reduced in size, so too, are their electronic components being asked to function at higher speeds and rates, but within smaller spaces. The competitiveness of today's marketplace places pressure on electronic manufacturers to decrease the size of their components, while increasing the efficiency thereof. This effect impacts the suppliers of components to these manufacturers. In particular, there is pressure on connector manufacturers to reduce the size of connectors while increasing the data throughput of the connector. As the size of a connector is decreased, the connector must function at a high rate and with a decrease in the inductance of the connector.

Although short and thick conductive terminals may provide lower inductance, they may not maintain their contact flexibility in a manner that would enhance their ability to mate with circuit boards and to meet the reduced pitch required for high density connectors. Terminals with greater flexibility typically include long and slender contact beams. Although such terminals may function adequately to provide a connection between the edge card contacts and the circuit board contacts, they may possess a high inductance. Inductance for the most part depends on the physical characteristics of the terminal.

Shortening of the circuit path of the terminal improves the performance of the terminal by lowering the inductance. Providing dual contacts on the base portion of the terminals, such as a solder tail on one part of the terminal and a surface mount foot on another part of the terminal, will also reduce the inductance of the terminal. Increasing the length of the terminal contact arms as is often necessary in multi-level edge card connectors for lower insertion force, will result in an increase in the inductance of the terminal that effectively will cancel out the reduction obtained by using dual contacts on the base of the terminal.

A need therefore exists for a high-speed, edge card connector having an improved electrical performance in which the inductance of the connector is reduced, without comprising the mechanical operation of the contact portions of the connector terminals.

SUMMARY OF THE INVENTION

It is therefore an object of the present invention to provide an improved edge card connector for use in high speed applications with reduced inductance.

Another object of the present invention is to provide an edge card connector having a plurality of terminals with minimal inductance without diminishing the mechanical performance thereof and further electrically coupled to improve the performance of the terminals.

Still another object of the present invention is to provide an edge card connector for high speed applications in which the connector includes a plurality of conductive terminals arranged on opposite sides of a card slot of the connector, the terminals being of at least two distinct types: a signal type and a ground type, the signal and ground-type terminals being alternatingly arranged lengthwise of the connector, the grounding type terminal having a pair of contact beams formed thereon, one of the pair of contact beams being deflectable into contact with the other of the contact beams upon insertion of the circuit card into the card-receiving slot.

Yet a further object of the present invention is to provide a connector having a plurality of terminals arranged on opposite sides of a connector slot, some of the terminals having a dual circuit path defined by a pair of contact beams formed therewith that are cantilevered vertically from a base portion of the terminals, one of the beams being deflectable into contact with the other to provide an additional circuit path for current or ground along the length of the terminal.

A still further object of the present invention is to provide an edge card connector suitable for high-speed applications in which the connector includes an elongated insulative connector housing, a card-receiving slot disposed within the connector housing and extending longitudinally therein, a plurality of conductive terminals arranged within the connector housing and disposed in pairs on opposite sides of the card-receiving slot, some of the terminals being signal terminals and other of the terminals being reference or power terminals, the reference or power terminals having a pair of contact arms that are movable into engagement with each to short the terminals in order to provide dual electrical paths upon insertion of a circuit card into the connector card-receiving slot, at least one of the contact arms being deflectable into contact with the other under urging of the circuit card.

Yet still another object of the present invention is to provide a high-speed connector having a selected set of conductive terminals that are capable of shorting themselves when a circuit card is inserted into a card slot of the connector, each of the selected terminals having primary and secondary contact members that take the form of cantilevered beams having free ends that are spaced apart from each other a distance that is generally less than the amount of deflection undergone by one of the two contact members when the circuit card is inserted such that when a circuit card is inserted into the card slot of the connector, one of the contact members is urged into sliding engagement with the other of the two contact members, the free ends thereof having cam surfaces that engage and slide along each other in order to define two distinct circuit paths within said terminal extending between the circuit card contacts and contacts on a circuit board.

A still further object of the present invention is to provide an improved circuit card connector particularly suitable for high speed applications having a plurality of signal terminals and a plurality of reference or power terminals arranged on both sides of a circuit card-receiving slot of the connector, the reference or power terminals having a pair of upright contact beams in opposition with each other and aligned for shorting contact with each other, one of the contact beams protruding partially into the card-receiving slot and deflecting into contact with the other contact beam when a circuit card is inserted into the card-receiving slot. The two contact beams have opposing free ends that slidingly engage each other due to urging of the circuit card when it is inserted into the card-receiving slot, the two contact beam free ends deflecting sideways a distance between one-half and one full material thickness of the contact beams, thereby establishing a shorting contact between the two beams without substantially or materially increasing the circuit card insertion force.

The present invention achieves these objects through a unique terminal structure in which selected terminals are provided with a pair of opposing spring arms that are spaced apart from each other at the tops of the terminals. One of the spring arms extends into the card slot and is deflectable rearwardly into its terminal-receiving cavity. The two spring arms are vertically cantilevered and extend up from a body portion of the terminal so that an edge of the circuit card will deflect the one spring arm into sliding contact with the other spring arm in order to define a second circuit path of the terminal through the other spring arm that deflects less than the spring arm that extends into the card slot. These two circuit paths improve the electrical performance of the connector by lowering its inductance.

When the free ends of the two spring arm portions contact each other, two parallel electrical paths are created. It is known that inductance of a terminal is dependent upon the length of the circuit path that extend through a terminal. The longer the circuit path, the greater the inductance. The spring arms of the present invention contact each other at the tops of their associated terminals to create an electrical short between the two spring arms to thereby define two distinct circuit paths that extend through the terminal. These circuit paths are preferably the same length. Each such circuit path will generate a given inductance, while the two spring arms act as a pair of inductors in parallel when contacted against each other and thereby generate an inductance that is lower than the actual inductance of either of the two spring arms alone.

The parallel circuit paths defined by the two spring arms of these selected terminals help keep the inductance of the selected terminals low. In order to further enhance the electrical performance of these selected terminals (as well as that of other terminals), the selected terminals may be provided with an area of enlarged surface area that promotes electrical coupling with adjacent terminals.

The free ends of the spring arm portions preferably include cam surfaces, which in one embodiment of the invention include angled surfaces, that slidingly engage each other when the circuit card is inserted into the card slot. Circuit cards may be manufactured to certain tolerances in which warpage of the circuit card may occur which may affect the connector structure. In order to counter such warpage, it is desirable to increase the extent of the one spring arms into the connector card slot. If the two spring arms were to meet face to face under application of a circuit card, a combined, larger force is generated to insert the circuit card, which increases the insertion force required for the circuit card. By providing cam surfaces at the free ends of the spring arms, and by providing them not only away from the connector housing slot, but also above the level of the card contact portions of the terminals, a minimal increase is achieved in the normal force required for insertion of the circuit card into the connector card-receiving slot and a small gap between the free ends and cam surfaces may be attained so that a reliable engagement may be had with as little as five-thousandths (0.005 inches) deflection.

The engagement of these two free ends is in a sliding, or frictional contact, type of engagement. This sliding action is oriented generally perpendicularly or transverse to a longitudinal axis of the connector housing card-receiving slot. The sliding contact in this direction leads to a maximum deflection of the contact beam being the material thickness of the contact beam and a minimum deflection of the same is about one-half a contact beam thickness.

These and other objects, features and advantages of the present invention will be clearly understood through a consideration of the following detailed description.

BRIEF DESCRIPTION OF THE DRAWINGS

In the course of the following description of the detailed description, reference will be made to the attached drawings wherein like reference numerals identify like parts and wherein.

DETAILED DESCRIPTION OF THE PREFERRED EMBODIMENTS

Figure 1:
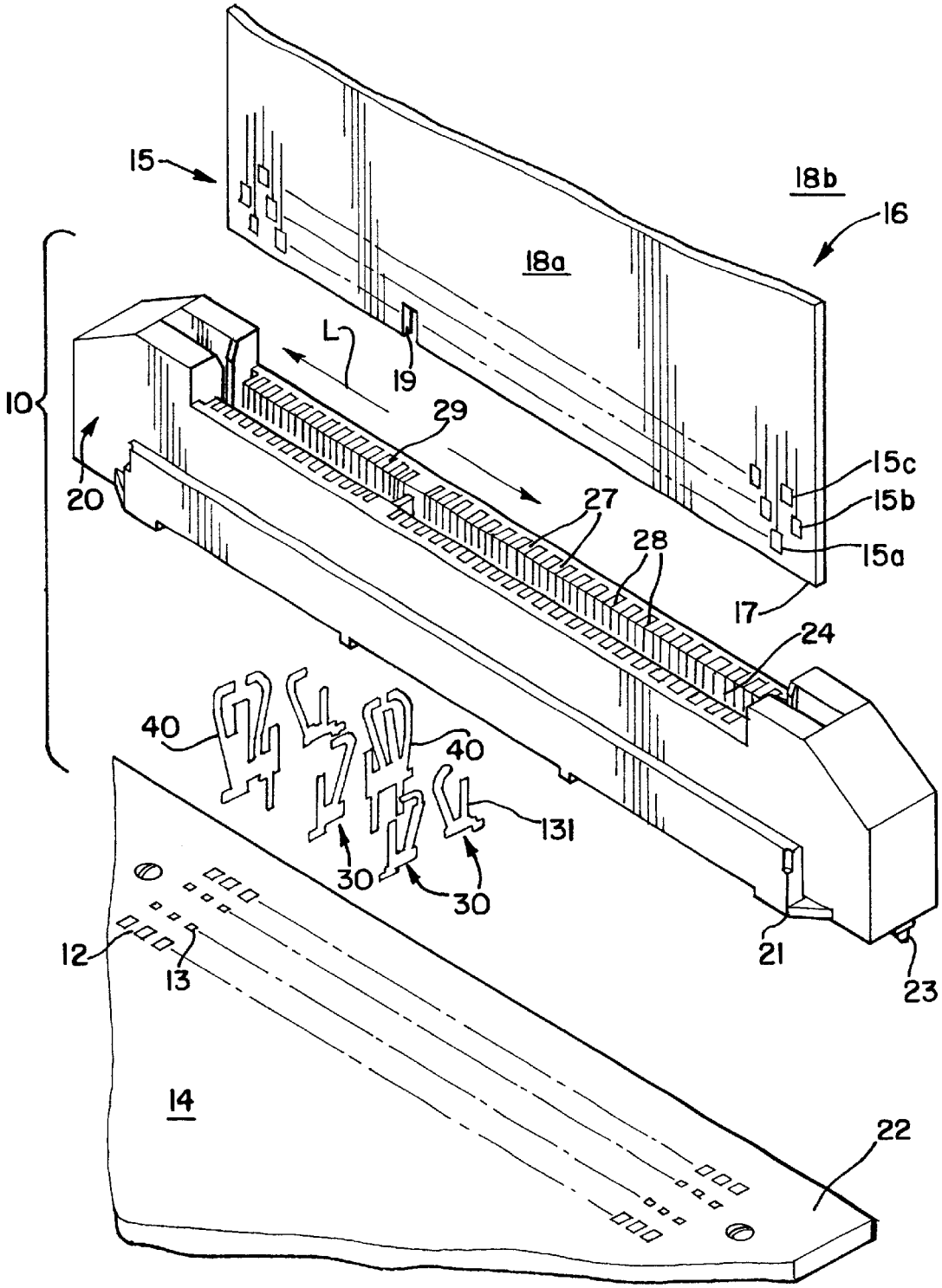
FIG. 1 is an exploded perspective view, of an embodiment of an electrical connector constructed in accordance with the principles of the present invention, with the terminals of the connector shown apart from the connector.

FIG. 1 illustrates a connector 10 that is used to connect a first plurality of conductive circuit traces 12 disposed on a first printed circuit board 14, such as the mother board shown, to a second plurality of conductive pads 15 that are disposed on a second printed circuit board, such as the circuit card or edge card 16 illustrated. The connector 10 has an elongated, insulative housing 20 with a base portion 21 that is mountable onto a mounting surface 22 of the circuit board 14 and may therefore include posts 23, or another suitable means of support, that may be received in complementary openings formed in the circuit board 14.

The connector housing 20 includes a slot 24 that extends lengthwise in the connector housing 20 and which is sized to receive the circuit card 16 therein. The housing 20 has a longitudinal axis L that extends through and runs the length of the card-receiving slot 24. The circuit card 16 has an edge 17 that is insertable into the card-receiving slot 24 and which separates two opposing sides 18*a*, 18*b* of the circuit card upon which circuit traces and associated electronic components may be located. One or more notches 19 may be formed in the circuit card 17 along the edge thereof in order to provide a means for polarizing the circuit card 17 and ensuring that it is inserted into the card-receiving slot 24 of the connector 20 in the proper orientation.

As is known in the art, the connector housing 20 includes a plurality of cavities 28 that are formed therein on opposite sides of the card-receiving slot 24. These cavities receive conductive terminals 30, 40 and the cavities extend transversely with respect to the card-receiving slot 24. The terminal-receiving cavities 28 communicate, along one face 29 thereof, with the card-receiving slot 24. The cavities 28 are partly defined and separated from each other by intervening walls 27 that are typically formed with the connector housing 20 during the manufacturing process.

Figure 2:
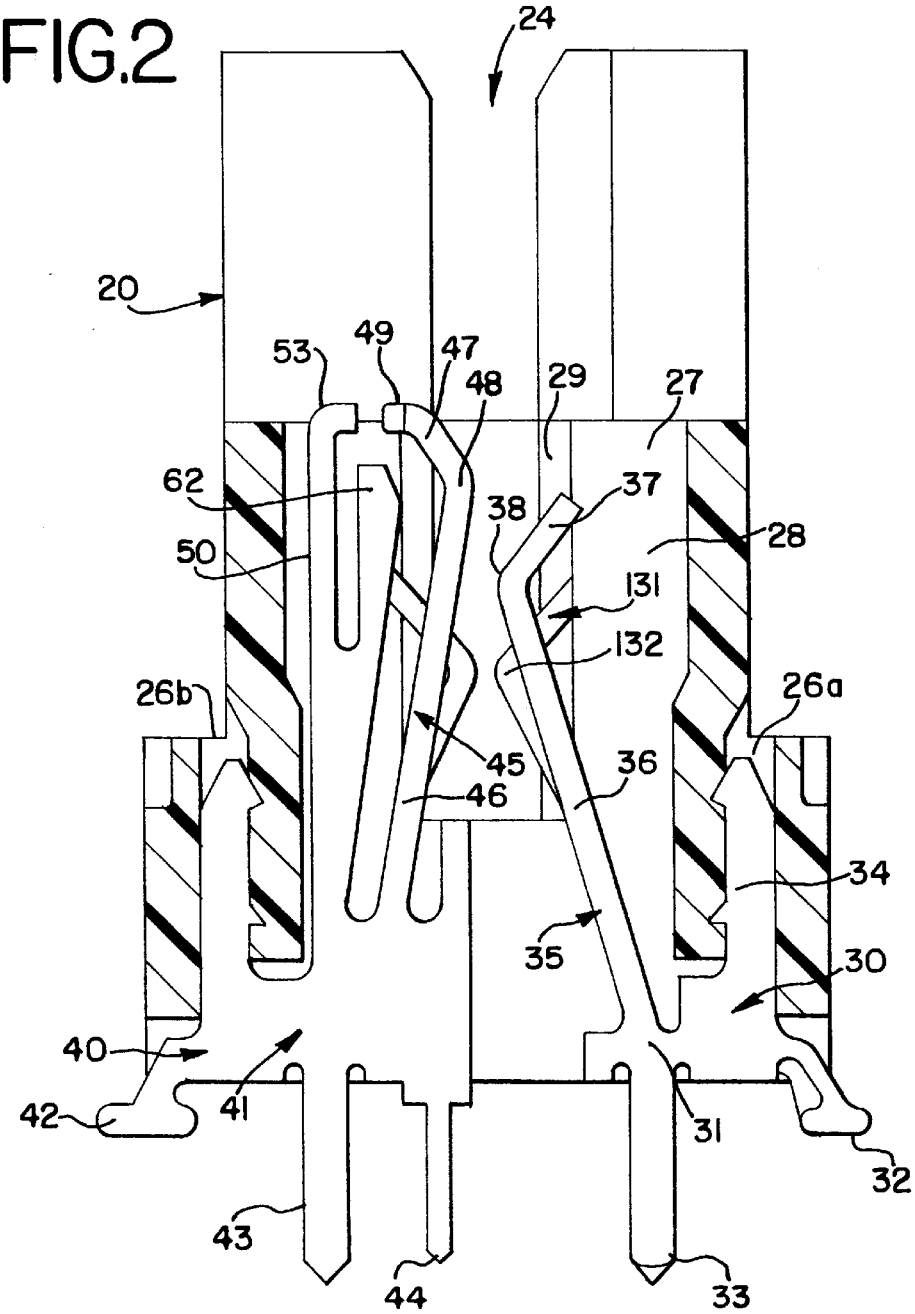
FIG. 2 is a sectional view of the connector of FIG. 1, in an assembled state and illustrating the card-receiving slot of the connector with the terminals in place in the connector on opposite sides of the card-receiving slot, with a dual-path, shorting terminal constructed in accordance with the principles of the present invention.

The connectors of the present invention may include either 2-tier or 3-tier connectors. FIGS. 1 and 2 illustrate the application of the principles of the present invention in a 3-tier connector, wherein the circuit card 16 has three rows of conductive pads 15*a*, 15*b*, 15*c* on its contact surfaces 18*a*, 18*b* and which are spaced apart from each other a predetermined distance. The terminals of the connector may include a plurality of conductive terminals, with each terminal having contact portions located at three distinct heights within the terminal-receiving cavities 28. Although three such terminals 30, 131 and 40 are shown in FIGS. 1 & 2, these terminals differ in terms of what they conduct, i.e., signal terminals 30, 131 and reference or power terminals 40, and further differ in terms of the heights within the card-receiving slot 24 of their associated contact portions 38, 132 and 48.

As mentioned above, the terminals 30, 40 of the connectors 10 of the present invention may be aptly described as falling into two distinct groups of terminals: signal terminals 30 and reference or power terminals 40. The signal terminals 30, will carry, as might be expected, electrical signals that may transmit data or other matter from the components mounted on the circuit card 16 to components mounted on the printed circuit board 14. The reference or power terminals 40 may be used either as power terminals that convey power to circuit card components, or may be used as ground terminals to provide a ground path or reference for the other terminals of the connectors. In the latter instance, the ground terminals may be used to provide a known reference voltage to an adjoining terminal so that selected terminals of the connector may be coupled to improve their electric performance.

Figure 8:
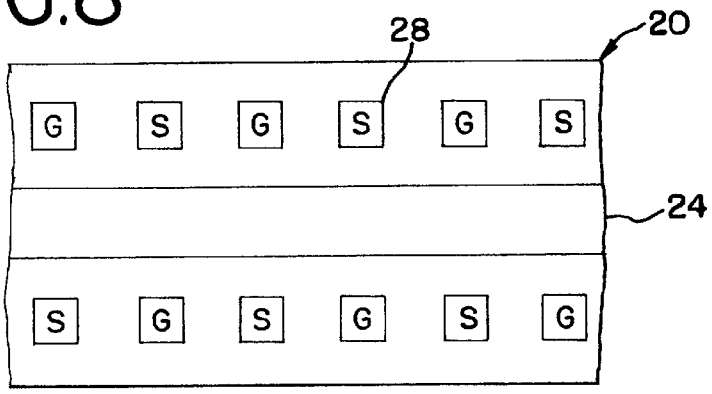
FIG. 8 is a schematic plan view of a two-tier embodiment of a connector incorporating the principles of the present invention; and, FIG. 9 is a schematic plan view of a three-tier embodiment of a connector incorporating the principles of the present invention.
Figure 9:
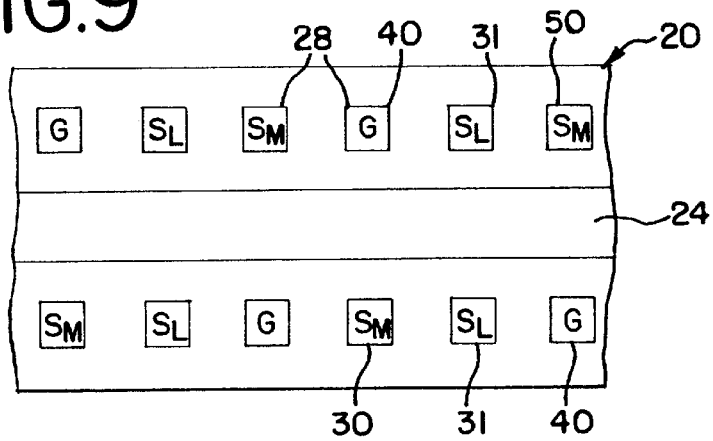

In most applications of the present invention, a reference or power terminal 40, such as a ground terminal G, will usually be positioned in a terminal-receiving cavity 28 across from a signal terminal S. This is shown schematically in FIG. 8, wherein a two-tier connector is presented in overall plan view and each signal terminal "S" has a ground terminal "G" flanking it and opposing it across the card-receiving slot 24. Similarly, in 3-tier connector applications, as shown in FIG. 9, pairs of signal terminals SL and SM (that respectively correspond to terminals 131 and 30 in FIGS. 1 & 2) are flanked on opposing sides by ground terminals G. In this application, it may be desirable to tie, or otherwise interconnect the ground terminals together along the base 21 of the connector housing 20 and beneath the card-receiving slot 24 hereof.

Turning now to FIG. 2, a pair of signal and reference or power terminals 30, 40 are illustrated in place with two respective terminal-receiving cavities 28 on opposite sides of the card slot 24 of the connector housing 20. The typical signal terminal 30 can be seen to include a base, or body portion 31 which preferably includes, at its outboard extent, a foot portion 32 for surface mounting of the terminal 30 onto a conductive pad of a circuit board 14, and at its inboard extent, a through hole tail portion 33 to provide dual paths for current of the signal terminals to traverse and divide into almost equal parts. A barbed housing retention portion 34 also preferably extends upwardly from the terminal body portion 31 for insertion and engagement with a retention cavity 26*a* formed in the connector housing 20 that is spaced apart from the terminal-receiving cavity 28 in which the signal terminal 30 is received.

The signal terminal 30 has an elongated spring arm portion 35 that extends up from the base portion in a cantilevered fashion. This spring arm portion 35 has a pair of angled portions 36, 37 that respectively are directed toward and away from the card slot 24 of the connector housing 20. The angled portions diverge from or mate with each other to form a contact portion 38 that extends into the card slot 24 in order to reliably contact a conductive pad 15 of the circuit card 16. The upper angled portion 37 acts somewhat as a "lead-in" portion that the edge card 16 contacts and smoothly deflects slightly rearwardly into its terminal-receiving cavity 28. The contact portions 38 of the signal terminals may be located at different heights on the terminals in order to accommodate two or three distinct tiers of contact pads 15 situated on the circuit card 16. These terminals 30 have their contact portions 38 at what may be considered as a middle height within the card-receiving slot 24 and between the contact portions of the lower signal terminals 131 and the contact portions of the reference or power terminals 40.

The reference or power terminal 40 also has a lower body portion 41 having a housing retention portion 57 and a surface mount foot 42 formed along one side thereof. It may also preferably include a through hole tail portion 43 of somewhat wide extent that is adapted for insertion into and partly through corresponding through holes 13 formed in the printed circuit board 14 that are spaced apart from the conductive surface mount pads 12. The surface mount foot 42 and the through hole tail 43 serve to provide dural paths for voltage, current, etc, exiting the reference or power terminal 40. An additional through hole tail 44 may be formed as part of the body portion 41 and extend interiorly of the middle through hole tail 43.

A spring arm portion 45 extends up from the terminal body portion 41 in a cantilevered fashion and may possess a pair of angled portions 46, 47 that meet together at a contact portion 48 that protrudes into the card-receiving slot 24 of the connector housing 20. In an important aspect of the present invention, the reference or power terminal 40 includes a second arm portion 50 that extends up in a cantilevered fashion from the terminal body portion 41. In this manner, it is easy to design a spring rate into the structure of the spring arm portion 45 so that its contact portion 48 will exert a desired normal force N (FIG. 4) against the circuit card contact pads 15. These two arm portions 45, 50 may be considered as respective primary and secondary contact beams as explained in more detail below.

Figure 3A:
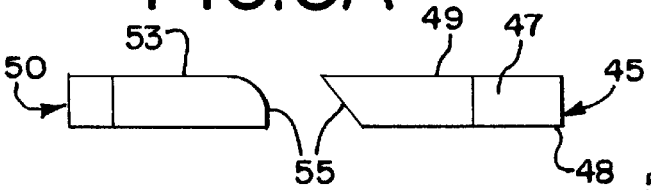
FIG. 3A is a partial top plan view of FIG. 2, taken along lines 3A—3A, thereof illustrating the separation of the primary and secondary contact beams of the dual-path, shorting terminal thereof and further illustrating the terminal in a "rest" position which occurs when no edge card is present in the card-receiving slot.
Figure 3B:
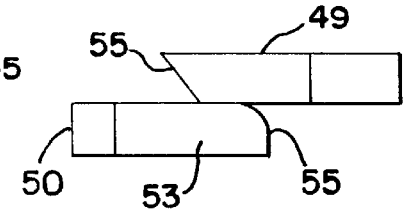
FIG. 3B is a partial top plan view of FIG. 4, taken along lines 3B—3B thereof, illustrating how contact occurs between the primary and secondary contact beams of the dual-path, shorting terminal when an edge card is inserted into the card-receiving slot of the connector.

The two arm portions 45, 50 are preferably spaced apart from and aligned with each other within the confines of the terminal-receiving cavity 28. Each of these two arm portions 45, 50 has a corresponding free end portion 49, 53. The tips 54 of these free ends 49, 53 are preferably coined to provide cam surfaces, shown in FIG. 3A as angled contact surfaces 55. The cam or contact surfaces 55 are preferably generally complementary to each other as shown in FIGS. 3A and 3B. The contact surfaces 55 need not necessarily be planar angled surfaces, but may possess a slightly curved profile that is easily achieved by coining as illustrated in FIG. 7.

Figure 4:
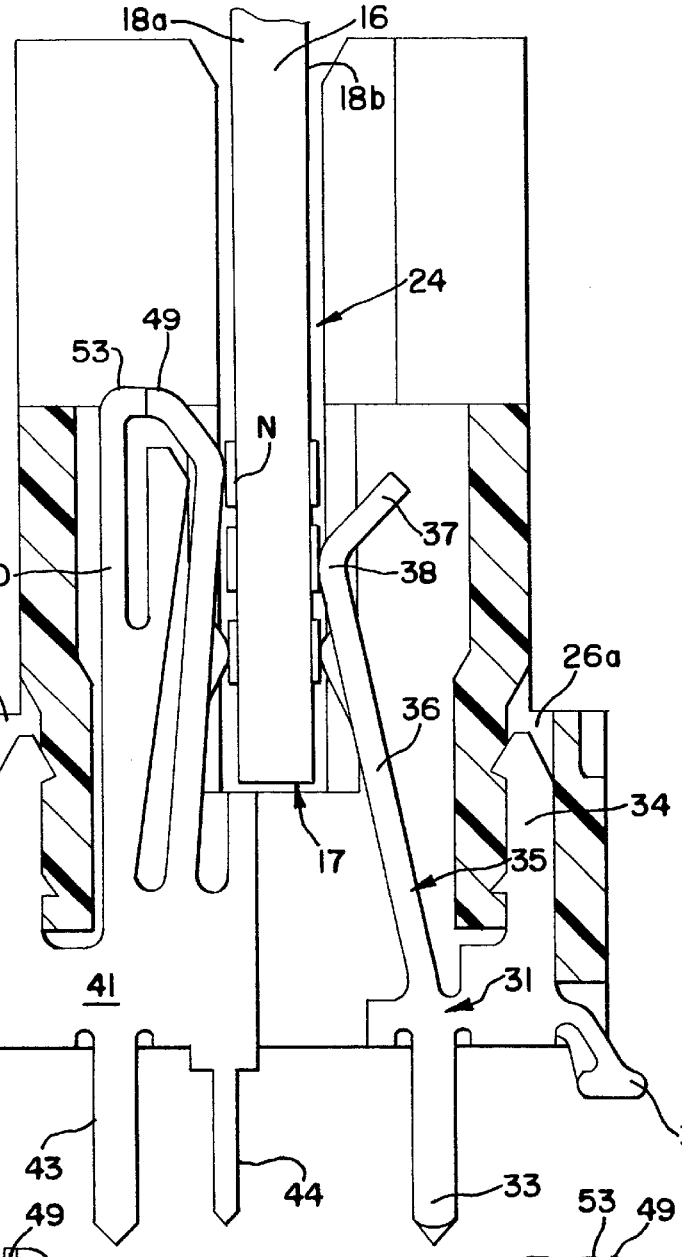
FIG. 4 is a sectional view of the connector of FIG. 1, and similar to FIG. 2, illustrating the position taken by the dual-path, shorting terminals of the connector when an edge card is inserted into the card-receiving slot of the connector.
Figure 5:
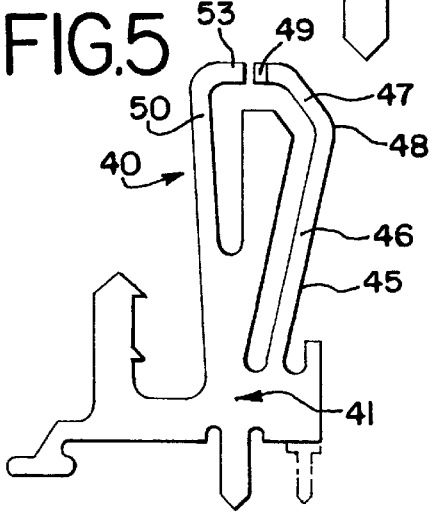
FIG. 5 is an elevational view of a reference or power terminal of the connector of FIG. 1.

These two free end or contact portions 49, 53 provide a means for "shorting" the reference or power terminal 40 along its top. The free ends will impinge upon each other under urging of the circuit card 16 when inserted into the card slot 24 as shown in FIG. 4. In the embodiment shown, due to length of the cantilever of the first spring arm portion 45 will deflect toward the end of the cavity 28 (or toward the left of FIG. 2) and contact the second arm portion 50. The contact surfaces 55 of the free ends of the two arm portions 45, 50 will contact each other and that of the first spring arm portion will tend to ride alongside the second arm portion.

This contact between the two spring arm potions 45, 50 is beneficial to the operation of the connecting 10 of the present invention because, as seen best in FIG. 4, the contact, in essence creates two distinct circuit paths through each of the spring arm portions 45, 50. Preferably, each of the circuit paths is of about the same length. These two circuit paths extend along the length of the spring arm portions 45, 50, into the reference or power terminal body portion 41 and the respective circuit traces on the circuit board via the two through hole tails 44. Importantly, the two spring arm portions 45, 50, where contacted together, act as parallel inductors that will generate an inductance that is lower in most instances than the actual inductance of any of the two spring arm portions standing alone, as shown by the equation for calculating two inductances in parallel:

$$LP_{TOT}=(L_1L_2)/(L_1+L_2)$$

which in the most part will result in a total inductance that is less than the total inductance of a series inductance which is calculated from: $L_{TOT}=L_1+L_2$.

In another important aspect of the present invention and as mentioned above, the free ends 53 of the two spring arm portions 45, 60 are arranged and configured so as to engage each other in a sliding and frictional contact, rather than a point-to-point normal contact where the contact surface of one of the two spring arm portions will abut the contact surface of the other of the two spring arm portions. This sliding structure assists in the mechanical operation of the reference or power terminal and offers advantages over the abutting-type contact used in known shorting contact applications.

It is not uncommon for warpage in circuit cards to occur during the manufacture thereof, so that possible board warpage will affect the operation for connector. In instances where a circuit card is manufactured out of tolerance, the spring arms of connector terminals may only minimally deflect against the circuit card and thereby not apply a desired normal force that ensues reliable contact between the terminals of the connector and the circuit card contact pads. In instances where abutting contact is chosen between the shorting contacts, that type of contact will exert a normal force between the shorted contacts in the opposite direction as that exerted by the terminal contact portion on the circuit card. This condition may affect the connection and contact reliability.

In the present invention, by virtue of the sliding contact between the free ends 53 of the spring arm portions 45, 50, the deflection that effects the shorting contact is moved to a different place and a different location. This location occurs for the most part between the free ends 53 of the spring arm portions and occurs along an extent that is generally transverse, or perpendicular to the longitudinal axis L of the card-receiving slot 24. Additionally, it occurs above the level (FIG. 4) of the contact portions 48 of the reference or power terminals 40 that contact the circuit card when it is inserted into the card-receiving slot 24.

The two spring arm portion contact surfaces 55 engage each other easily in the circuit card insertion process without any detrimental change, i.e., increase, in the normal force N exerted by the terminals 40 into the circuit card. In the present invention the gap 60 between the two spring arm portion free ends 49, 53 is minimized down to at least the order of approximately 0.5 mils so that shorting contact is obtained with as little as 0.005 inches of defection. Such gap may be effectively obtained by coining the contact surfaces.

Figure 7A:
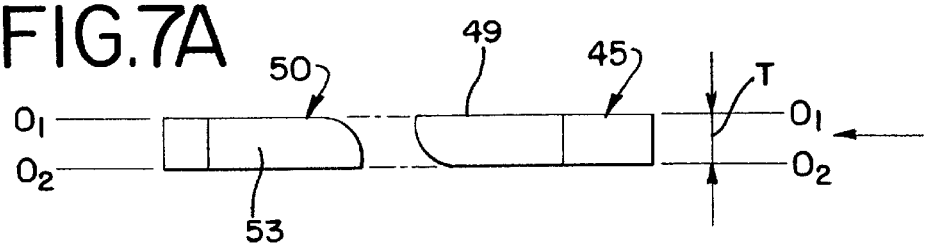
FIG. 7A is a partial detail plan view of FIG. 2, illustrating the two free ends of the contact beams of the reference or power terminal aligned with each other in a rest position.
Figure 7B:
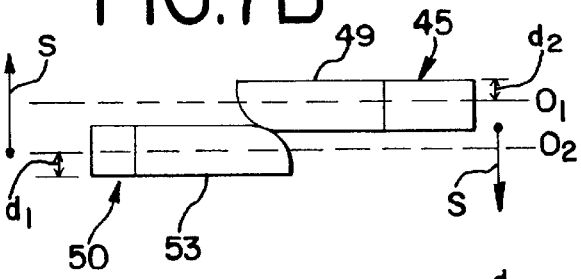
FIG. 7B is the same view as FIG. 7A, but illustrating the contact beams engaged together in a shorting contact and with each of the contact beams partially deflected with respect to each other and illustrating the minimum deflection between the contact beams.
Figure 7C:
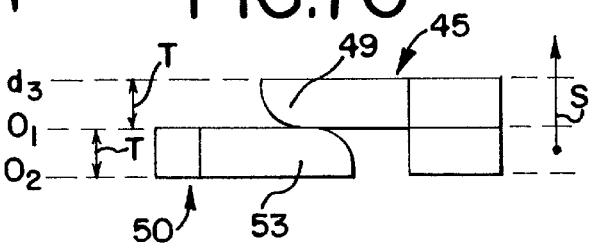
FIG. 7C is the same view as FIG. 7A, but illustrating the contact beams engaged together in shorting contact and illustrating the maximum deflection between the contact beams.

An example of this deflection is depicted in FIGS. 7A–7C. In FIG. 7A, the two free ends 49, 53 of the spring arm portions 45, 50 of a reference or power terminal 40 are shown as viewed from the top of the terminal 40 and it can be seen that both such portions are generally aligned with each other along lines $O_1$ and $O_2$ that define the bounds of the material thickness of the contact beams. When the circuit card is inserted into the card slot 24, the primary spring arm portion 45 is deflected resoundly into contact with the secondary spring arm portion 50. The contact surfaces 55 ride up on each other and the two spring arm portions 45, 50 deflect slightly sideways so that they are partially outside of lines $O_1$ and $O_2$. Thus, it will be noted that the normal deflection of the primary spring arm portion is kept to a minimum (the deflection that occurs along arrow N in FIG. 7A), while the total sideways deflection (the deflection that occurs along the arrows S in FIGS. 7A & 7B) may range between about one-half of the material thickness T of the terminal 40 to about a full material thickness T thereof.

FIG. 7B illustrates the condition where the minimum deflection of the contact beams is one-half a material thickness, as represented by $d_1$ and $d_2$. FIG. 7C illustrates the condition where the maximum deflection of the contact beams is equal to a material thickness T thereof, such as where one of the contact portion 50 is more restrained in its sideways movement than the other contact portion, and as such, one of the contact portion free ends, shown as the primary contact portion free end 49 deflects fully sideways as shown to bound $d_3$.

In a still further aspect of the present invention, the primary and secondary spring arm portions 45, 50 extend around a portion of the terminal 40 that presents an enlarged surface area portion 62. This enlarged surface area portion 62 extends up from the terminal body portion 41 and facilitates electrical coupling between the reference or power terminal 40 and an adjacent signal terminal. This coupling entrances the cross-coupling between adjacent points of signal and ground or powers reference or power terminals, while it diminishes cross-coupling between adjacent signal terminals. In instances where the reference or power terminal 40 is used as a power terminal, the enlarged surface area portion 62 enables the terminal 40 carry a larger current. The two circuit paths also facilitate this aspect.

Figure 6:
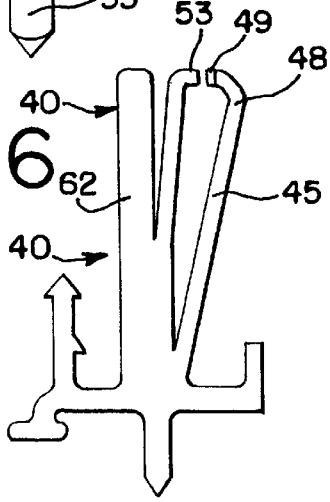
FIG. 6 is another embodiment of a reference or power terminal utilized in the connectors of FIG. 1.

Although the enlarged surface area portion 62 is being disposed between the two spring arm portions, it will be noted that it may also be located outside of the two spring arm portions as shown in FIG. 6.

While the preferred embodiments of the invention have been shown and described, it will be appreciated by those skilled in the art that changes and modifications may be made to these embodiments without departing from the spirit of the invention, the scope of which is defined by the appended claims.

What is claimed:

1. A connector for providing a connection between first and second circuit boards, the second circuit board having an edge for insertion into the connector, said connector comprising:

an electrically insulative housing having a predetermined length, the housing having a slot disposed therein, the slot being dimensioned to receive the edge of said second circuit board therein;

said housing including a plurality of conductive terminals disposed on opposite sides of said slot, said terminals including first and second terminals for contacting circuit traces of respective first and second types disposed on said second circuit board when said second circuit board is inserted into said slot;

each of said first signal terminals having a tail portion extending from said housing for contacting one of said first circuit board circuit traces, a contact portion facing said slot for contacting the first type of said second circuit board circuit traces when said second circuit board is inserted into said housing slot, and a body portion interconnecting said tail and contact portions;

each of said first reference or power terminals having a tail portion extending from said housing for contacting one of said first circuit board circuit traces, and a primary contact portion facing said slot for contacting one of said second type of second circuit board circuit traces when said second circuit board is inserted into said housing slot, and a body portion interconnecting said tail and primary contact portions, said primary contact portion extending upwardly from said body portion in a cantilevered fashion and providing a first circuit path between one of said second type of second circuit board traces and a corresponding circuit trace of said first circuit board;

each of said second terminals further including a secondary contact portion extending upwardly from said body portion in a cantilevered fashion and spaced apart from said primary contact portion, said primary contact portion being deflectable in response to insertion of said second circuit board into said slot and into shorting contact with said secondary contact portion to provide a second circuit path from said one of said second circuit board circuit traces to said corresponding circuit trace on said first circuit board by way of said secondary contact portion, said primary and secondary contact portions including respective primary and secondary free ends that oppose each other, each of said primary and secondary free ends having camming surfaces that cause at least one of said primary and secondary free ends to slide along the other of said primary and secondary free ends when said second circuit board is inserted into said housing slot and contacts said second terminals.

2. The connector of claim 1, wherein said second terminals are reference terminals.

3. The connector of claim 1, wherein said second terminals are power terminals.

4. The connector of claim 1, wherein said first and second circuit paths are approximately the same length.

5. The connector of claim 1, wherein said primary and secondary contact portions are separated from each other by a gap of a predetermined distance, the distance being equal to a minimum amount of deflection that said primary contact portion undergoes in response to insertion of said circuit card into said slot.

6. The connector of claim 1, wherein each of said second terminals includes an enlarged surface area portion interposed between said primary and second contact portions.

7. The connector of claim 6, wherein each of said second terminals is flanked by at least one first terminal disposed adjacent thereto and said enlarged surface area portion enhances electrical coupling between said second terminal and said adjacent first terminal.

8. The connector of claim 6, wherein said enlarged surface area portion extends from said body portion in a cantilevered fashion.

9. The connector of claim 6, wherein said enlarged surface area portion extends rearwardly from said secondary contact portion.

10. The connector of claim 6, wherein said enlarged surface area portion is aligned with and enclosed within said primary and secondary contact portions and wherein said primary and secondary contact portions are spaced apart from each other above said enlarged surface area portion.

11. The connector of claim 1, wherein said primary and secondary contact portions are separated from each other by a gap of predetermined distance and are aligned with each other in a direction generally transverse to said slot, the primary and secondary contact portions having respective free ends that oppose each other on opposite sides of the gap, said primary and secondary contact portion free ends having opposing contact surfaces thereon that contact each other when said circuit card is inserted into said slot.

12. The connector of claim 11, wherein said free end contact surfaces are angled.

13. The connector of claim 11, wherein said free end contact surfaces are arcuate.

14. The connector of claim 1, wherein said primary and secondary free ends are disposed within said connector housing, but away from said slot.

15. The connector of claim 14, wherein said primary and second contact portion free ends are further disposed at a level within said second terminal above said primary contact portion.

16. The connector of claim 11, wherein said free end contact surfaces mate with each other in sliding engagement when said circuit card is inserted into said slot, said sliding engagement causing at least one of said primary and secondary contact portions to move sideways along a length of said connector housing.

17. The connector of claim 16, wherein said at least one of said primary and secondary contact portions moves sideways not less than one-half of its thickness and not more than its thickness.

18. A connector for providing a connection between a circuit board and an edge card, the edge card having an edge that is insertable into the connector, said connector comprising:

an electrically insulative housing having a predetermined length, the connector housing having a card-receiving slot disposed therein, the card-receiving slot being dimensioned to receive the edge of said edge card therein;

said connector housing including a plurality of conductive terminals disposed on opposite sides of said card-receiving slot, said terminals including first and second distinct types of terminals;

the first type terminals having body portions that are retained with said connector housing, tail portions extending away from said body portions and from said connector housing, contact potions extending from said body portions and facing said card-receiving slot for contacting circuit traces on said edge card when said edge card is inserted into said housing slot, said body portions interconnecting said tail and contact portions together;

the second terminals having body portions that are received within a portion of said connector housing, tail portions extending from said body portions and from said connector housing for contacting said circuit board, primary contact portions extending from said body portions that face said card-receiving slot for contacting said edge card when inserted into said card-receiving slot, said primary contact portions having free ends which are coined, and secondary contact portions extending from said body portions in opposition to, but spaced apart from said primary contact portions, said secondary contact portions having free ends which are coined, whereby said primary contact portions provide first circuit paths between said edge card and said circuit board and whereby said primary contact portions are deflectable into sliding contact with said secondary contact portions in response to insertion of said edge card into said card-receiving slot such that said secondary contact portions provide second circuit paths between said edge card and said circuit board that are distinct from said first circuit paths.

19. The connector as claimed in claim 18, wherein said second terminal primary and secondary contact portion have opposing free ends, the free ends defining shorting contact surfaces on said primary and secondary contact portions, said shorting contact surfaces having a configuration such that at least one of said primary and secondary contact portion free ends deflects sideways and slides alongside the other when said edge card is inserted into said card-receiving slot.

20. The connector as claimed in claim 18, wherein said second terminal primary and secondary contact portion free ends abuttingly contact each other when said edges card is inserted into said card-receiving slot, at least one of said second terminal primary and secondary contact portion free ends deflecting sideways during said contact.

21. The connector as claimed in claim 20, wherein each of said second terminal primary and secondary contact portion free ends have the same preselected thickness, and said at least one of said primary and secondary contact portion free ends deflects no less than one-half of said thickness and deflects no greater than said thickness.

22. A connector for providing a connection between a circuit board and a circuit card, the circuit card having an edge that is insertable into the connector, said connector comprising:

an electrically insulative housing of predetermined length and having a circuit card-receiving slot disposed therein for receiving the edge of said edge card therein;

a plurality of electrically conductive terminals disposed on opposite sides of said circuit card-receiving slot, said terminals including first and second distinct types of terminals;

the first type terminals having body portions disposed with said connector housing, tail portions extending away from said connector housing, contact portions facing said circuit card-receiving slot and partially extending therein for contacting circuit traces on said circuit card when said circuit card is inserted into said circuit card-receiving slot, said body portions interconnecting said tail and contact portions together;

the second terminals having body portions disposed within said connector housing, tail portions extending away from said connector housing, primary contact portions facing said circuit card-receiving slot and partially extending therein for contacting said circuit traces on said circuit card when said circuit card is inserted into said circuit card-receiving slot, said second terminals further including secondary contact portions disposed in opposition to and spaced apart from said primary contact portions, said body portions interconnecting said primary and secondary contact portions with said tail portions, said primary and secondary contact portions having respective free ends separated by an intervening gap, whereby upon insertion of said circuit card into said circuit card-receiving slot, said primary contact portion free ends are deflected into shorting contact with said secondary contact portion free ends, said primary and secondary contact portion free ends engaging each other in a sliding contact, whereby at least one of said primary and secondary contact portion free ends deflects sideways.

* * * * *